US008104940B2

(12) United States Patent
Ochiai

(10) Patent No.: US 8,104,940 B2
(45) Date of Patent: Jan. 31, 2012

(54) VEHICLE HEADLAMP

(75) Inventor: Takayuki Ochiai, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 254 days.

(21) Appl. No.: 12/621,546

(22) Filed: Nov. 19, 2009

(65) Prior Publication Data

US 2010/0124070 A1 May 20, 2010

(30) Foreign Application Priority Data

Nov. 19, 2008 (JP) ..... 2008-296183

(51) Int. Cl.
*F21V 17/02* (2006.01)

(52) U.S. Cl. ..... 362/512; 362/513; 362/538; 362/539; 362/284

(58) Field of Classification Search ..... 362/284, 362/507, 512, 513, 517, 518, 538, 539, 465
See application file for complete search history.

(56) References Cited

U.S. PATENT DOCUMENTS

| | | | | |
|---|---|---|---|---|
| 6,312,147 | B2 * | 11/2001 | Eichler | 362/539 |
| 7,350,946 | B2 * | 4/2008 | Yagi et al. | 362/517 |
| 7,370,996 | B2 * | 5/2008 | Ohshio | 362/539 |
| 7,478,933 | B2 * | 1/2009 | Tajima et al. | 362/512 |
| 7,736,038 | B2 * | 6/2010 | Suzuki | 362/539 |
| 2001/0021113 | A1 * | 9/2001 | Eichler | 362/539 |
| 2004/0240223 | A1 | 12/2004 | Brun et al. | |
| 2006/0120096 | A1 | 6/2006 | Naganawa et al. | |
| 2008/0055920 | A1 | 3/2008 | Okada | |

FOREIGN PATENT DOCUMENTS

| | | | |
|---|---|---|---|
| DE | 10218310 | A1 | 10/2002 |
| DE | 10200604254 | A1 | 3/2007 |
| EP | 1286106 | A1 | 2/2003 |
| JP | 2005-276761 | A | 10/2005 |

OTHER PUBLICATIONS

Extended European Search Report dated Sep. 29, 2011 from the European Patent Office in counterpart application No. 09014404.9.

* cited by examiner

*Primary Examiner* — John A Ward
(74) *Attorney, Agent, or Firm* — Sughrue Mion, PLLC

(57) ABSTRACT

A vehicle headlamp includes a projection lens, a halogen bulb disposed behind a rear focal point of the projection lens and below an optical axis, a main reflector which forwardly reflects and converges a first part of direct light from the halogen bulb toward the optical axis, the halogen bulb being inserted in the main reflector in a sidewise direction, a movable shade disposed between the projection lens and the halogen bulb to shield a portion of the first part of the light reflected by the main reflector and a second part of the direct light from the halogen bulb to form a cutoff line, an actuator which moves the movable shade, and an auxiliary reflector disposed below the optical axis to forwardly and diffusely reflect a third part of the direct light from the halogen bulb such that the third part of the light passes below the projection lens.

7 Claims, 6 Drawing Sheets

VEHICLE HEADLAMP

CROSS-REFERENCE TO RELATED APPLICATION

The present application claims priority from Japanese Patent Applications No. 2008-296183 filed on Nov. 19, 2008, the entire content of which is incorporated herein by reference.

FIELD OF INVENTION

Apparatuses consistent with the present invention relate to a vehicle headlamp, more particularly, to a projector-type vehicle headlamp having a variable light distribution function capable of changing a light distribution of the headlamp depending on vehicle driving conditions.

DESCRIPTION OF RELATED ART

Generally, a vehicle headlamp having a projector-type lamp unit is configured such that light from a light source disposed on an optical axis extending in a front-rear direction of a vehicle is forwardly reflected toward the optical axis by a reflector, and such that the reflected light is forwardly sent from the lamp unit through a projection lens.

In a case in which the projector-type lamp unit is configured as a low beam lamp unit, a shade is provided between the projection lens and the reflector to shield a part of the light reflected by the reflector to eliminate upward irradiation of light, whereby a forward beam irradiation with a low beam light distribution pattern having a cutoff line is implemented.

The shade is usually stationary, in which case, if the shade is configured to obtain a low beam light distribution pattern for example, a lamp unit having this shade can be used only as the low beam lamp unit, and cannot switch from a low beam to a high beam.

Hence, a related art projector-type lamp unit has a movable shade which moves between a low beam position and a high beam position. When the movable shade is located in the low beam position, an upper edge of the movable shade is positioned at or near a focal point of a projection lens to form a cutoff line of a low beam, and when the shade is located in the high beam position, the upper edge is moved away from the focal point of the projection lens to form a high beam.

Another related art projector-type lamp unit, on the other hand, is configured as a side insertion type lamp unit in which a light source bulb having an light emitting portion is fixedly inserted into a reflector in a sidewise direction with respect to an optical axis to reduce a length of the lamp unit in a front-rear direction of the vehicle (see, e.g., JP 2005-276761 A).

However, in a configuration in which the related art side insertion type lamp unit is modified by simply making the shade movable, a halogen bulb, which is less costly than a discharge bulb (e.g., a metal halide bulb), cannot practically be used as the light source bulb because of an insufficient amount of produced light.

In other words, the amount of light produced by a halogen bulb, which is smaller than the amount of light produced by a discharge lamp, is insufficient to provide a practical level of visibility in a single projector-type lamp unit for both high beam light distribution, which requires long distance reachability, and a low beam light distribution, which requires a wide expansion in a short distance region when used in the related art side insertion type lamp unit.

BRIEF SUMMARY

Illustrative aspects of the present invention provide a projector-type vehicle headlamp with a side insertion type lamp unit, which uses a halogen bulb and which has a variable light distribution function.

According to an illustrative aspect of the present invention, a vehicle headlamp is provided. The vehicle headlamp includes a projection lens disposed on an optical axis extending in a front-rear direction of a vehicle, a halogen bulb disposed behind a rear focal point of the projection lens and below the optical axis, a main reflector which forwardly reflects a first part of direct light from the halogen bulb to converge the first part of the light toward the optical axis, wherein the halogen bulb is fixedly inserted in the main reflector in a sidewise direction with respect to the optical axis, a movable shade disposed between the projection lens and the halogen bulb to shield a portion of the first part of the light reflected by the main reflector and a second part of the direct light from the halogen bulb to form a cutoff line of a light distribution pattern, an actuator which moves the movable shade between a shielding position, at which an upper edge of the movable shade is located in a vicinity of the rear focal point of the projection lens, and a lessened shielding position, at which an amount of the first part of the light shielded by the movable shade is less than an amount of the first part of the light shielded when the movable shade is at the shielding position, and an auxiliary reflector disposed below the optical axis to forwardly and diffusely reflect a third part of the direct light from the halogen bulb such that the third part of the light passes below the projection lens.

Other aspects and advantages of the invention will be apparent from the following description, the drawings and the claims.

DETAILED DESCRIPTION

Now an exemplary embodiment of the present invention will be described in detail with reference to the drawings. The following exemplary embodiment is an example only and does not limit the scope of the present invention as defined by the claims.

Figure 1:
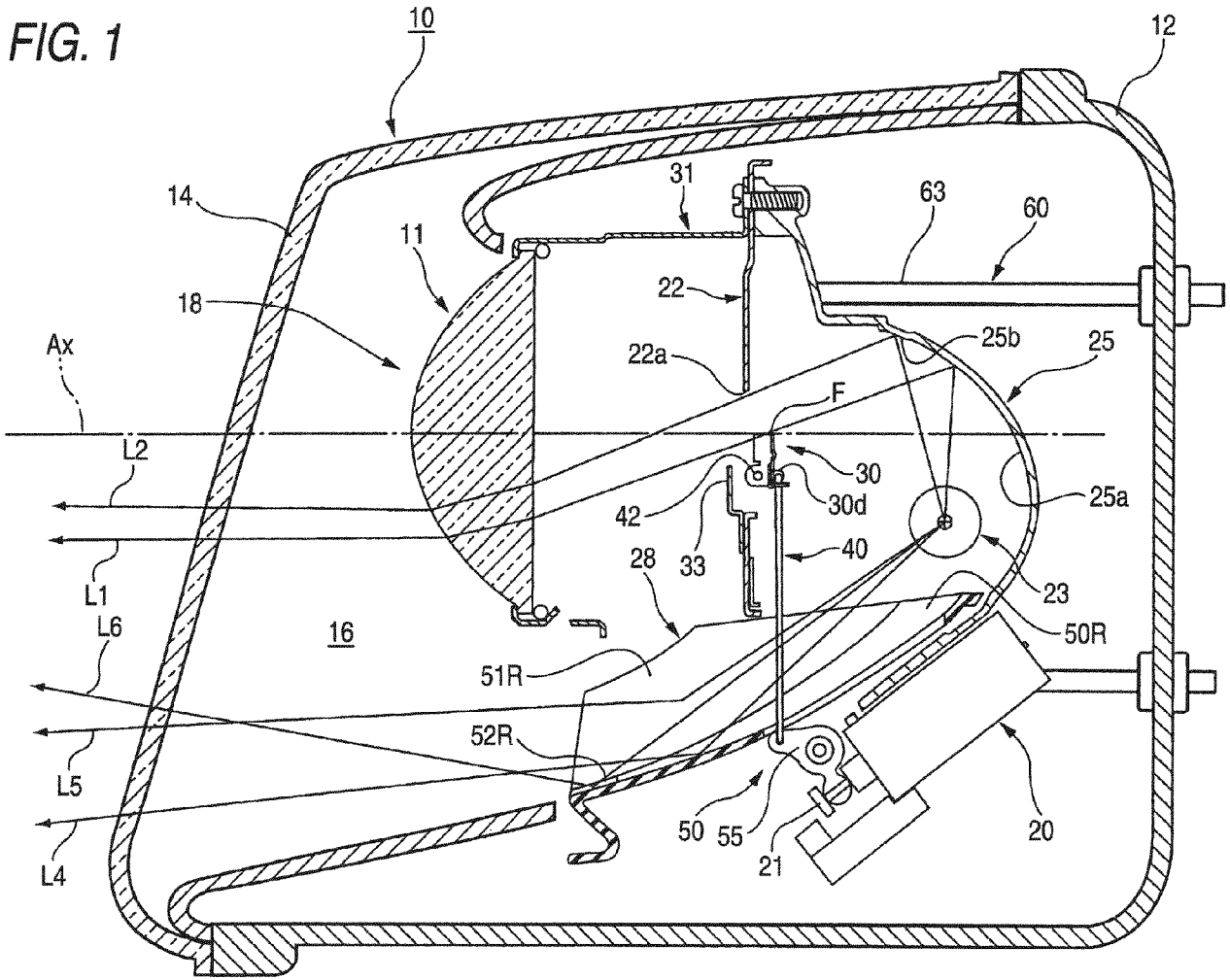
FIG. 1 is a vertical sectional view of a vehicle headlamp according to an exemplary embodiment of the present invention.
Figure 2:
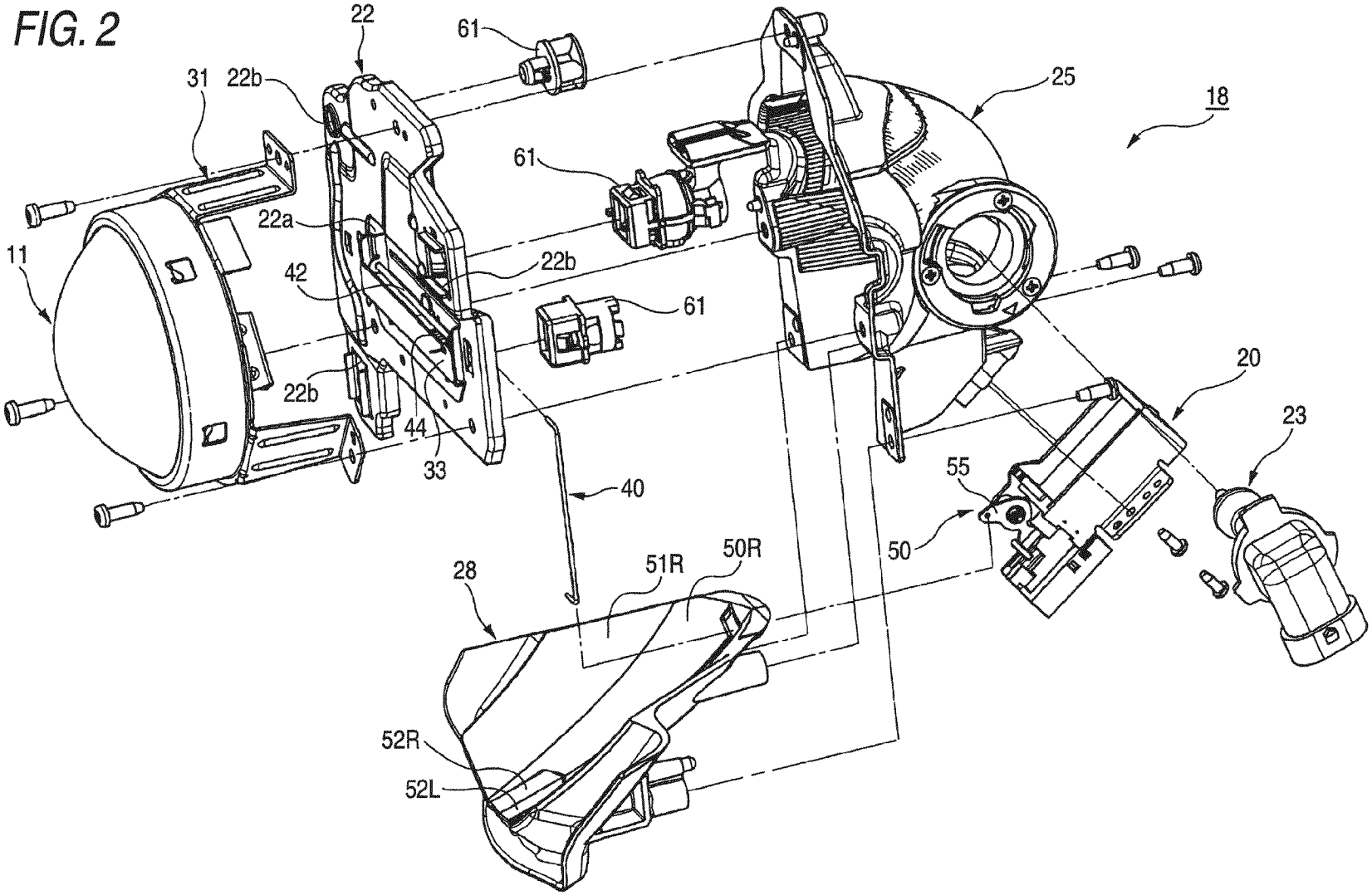
FIG. 2 is an exploded perspective view of a lamp unit according to the exemplary embodiment shown in FIG. 1.

As shown in FIGS. 1 and 2, a vehicle headlamp 10 according to the exemplary embodiment has a lamp body 12 having a front opening, a plain transparent cover 14 which covers the front opening of the lamp body 12 to form a lamp chamber 16, and a lamp unit 18 accommodated inside the lamp chamber 16.

The lamp unit 18 is supported on the lamp body 12 via a bracket 22. The bracket 22 is supported on the lamp body 12 via an aiming mechanism 60.

The aiming mechanism 60 is for fine-adjustment of an installation position and an installation angle of the lamp unit 18. The aiming adjustment is implemented such that an optical axis Ax of the lamp unit 18 (a central axis of a projection lens 11) extends downward by between about 0.5 and about 0.6 degrees with respect to a front-rear direction of a vehicle on which the headlamp 10 is mounted.

Figure 3:
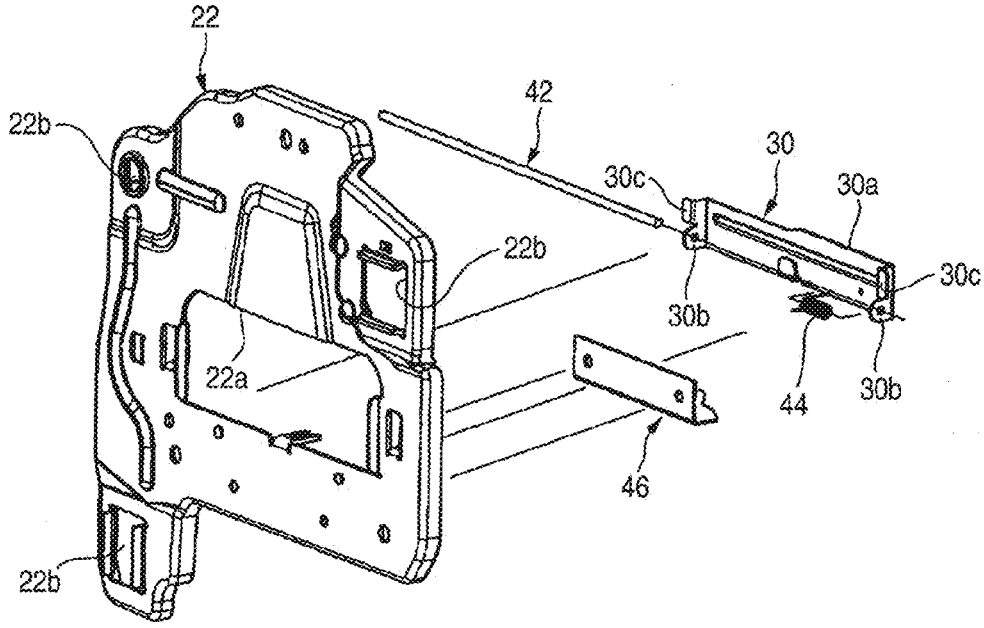
FIG. 3 is an exploded perspective view of a shade assembly shown in FIG. 2.

The bracket 22 is formed by pressing a rectangular metal plate as shown in FIG. 3. More specifically, the bracket 22 is formed with a central opening section 22*a* through which the optical axis Ax passes, and three attaching holes 22*b* to which bearing members 61, which each engage with an end of one of the associated aiming screws 63 of the aiming mechanism 60, are respectively attached.

The bracket 22 serves as a base of a shade assembly and prevents stray light reflected by a reflecting surface 25*a* of a main reflector 25 from entering the projection lens 11. The projection lens 11 is fixedly secured to a front side of the bracket 22 via a lens holder 31, and the main reflector 25 is fixedly secured to a rear side of the bracket 22.

Figure 4:
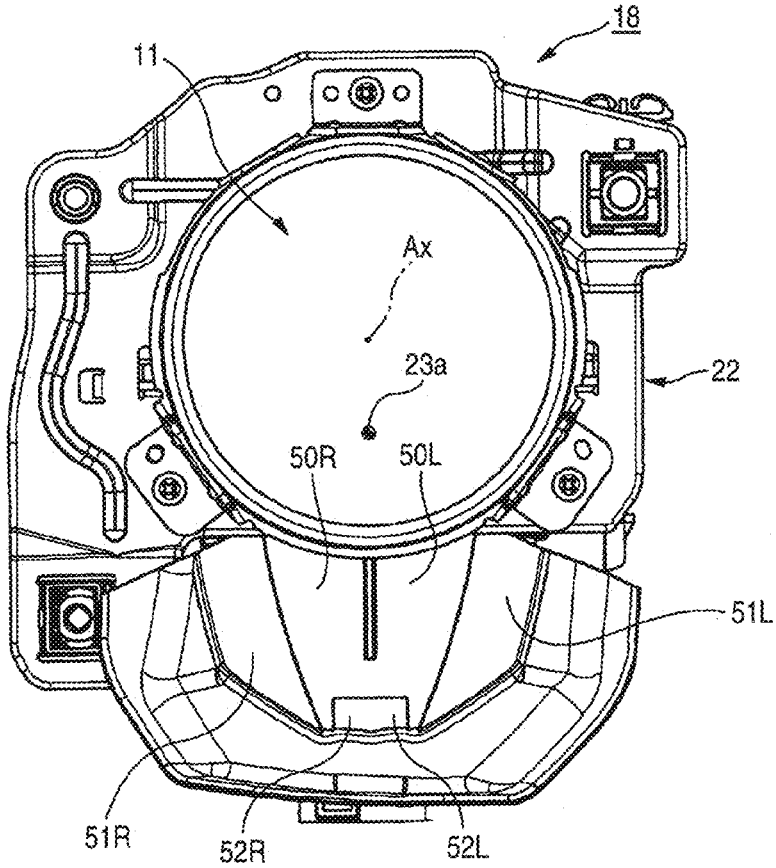
FIG. 4 is a front view of the lamp unit.
Figure 5:
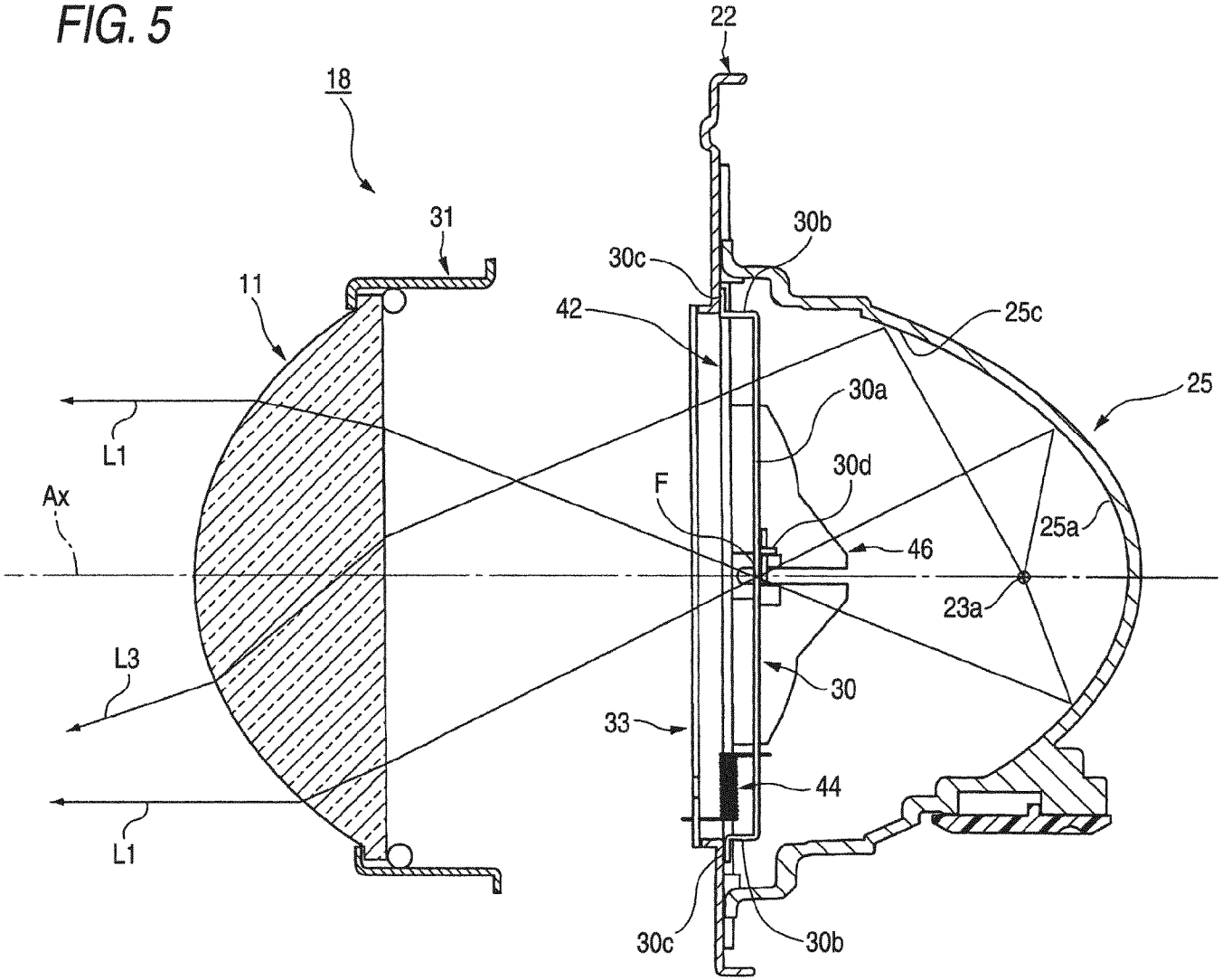
FIG. 5 is a horizontal sectional view of the lamp unit according to the exemplary embodiment.

In addition, as shown in FIGS. 3 to 5, a control member 46 is provided on a lower part of the rear side of the bracket 22. The control member 46 shields a part of direct light emitted from a halogen bulb 23 toward an auxiliary reflector 28 to control light to be reflected by the auxiliary reflector 28.

The lamp unit 18 according to this exemplary embodiment is a projector-type lamp unit. As shown in FIGS. 1 and 2, the lamp unit 18 includes the projection lens 11 disposed on the optical axis Ax extending in the front-rear direction of the vehicle, the halogen bulb 23 disposed behind a rear focal point F of the projection lens 11, the main reflector 25 which forwardly reflects a first part of the direct light emitted from the halogen bulb 23 to converge the first part of the light toward the optical axis Ax, a movable shade 30 disposed between the projection lens 11 and the halogen bulb 23 to shield a portion of the light L1 reflected by the main reflector 25 and a second part of the direct light from the halogen bulb 23 so as to form a cutoff line CL of a light distribution pattern, an actuator 20 which moves the movable shade 30 between a shielding position, at which an upper edge 30*a* of the movable shade 30 is disposed in a vicinity of the rear focal point F of the projection lens 11, and a lessened shielding position, at which an amount of the portion of the light L1 shielded by the movable shade 30 is less than the amount of light shielded at the shielding position, and the auxiliary reflector 28 disposed below the optical axis Ax to forwardly and diffusely reflect a third part of the direct light from the halogen bulb 23 such that the third part of the light passes below the projection lens 11 without entering the projection lens 11.

The projection lens 11 is a plano-convex lens having a convex front surface and a flat rear surface. As shown in FIG. 1, the projection lens 11 is disposed on the optical axis Ax to forwardly project an image on a focal plane, including the rear focal point F, as a reverted image.

According to the exemplary embodiment, a diameter of an effective surface of the projection lens 11 is 80 mm, which is larger than a diameter of an effective surface of a generally used lens which is about 60 mm. That is, a focal length of the projection lens 11 is increased and a size of the image of the light source is reduced, whereby it is possible to increase a light amount and a luminous flux of the lamp unit 18.

Further, a microstructure is formed on a surface of the projection lens 11 to suppress a contrast of bright and dark along the cutoff line CL, where a level of light convergence is high, from being too sharp, which would otherwise have an adverse effect on visibility.

The halogen bulb 23 is configured to have a line segment light source 23*a* which extends in a direction of a central axis of the halogen bulb 23. The halogen bulb 23 is fixedly inserted in the main reflector 25 in a sidewise direction with respect to the optical axis Ax and below the optical axis Ax, such that the central axis of the halogen bulb 23 is oriented to substantially intersect with the optical axis Ax. Here, "oriented to substantially intersect with the optical axis Ax" includes an arrangement in which the central axis of the halogen bulb 23 three-dimensionally intersects with respect to the optical axis Ax extending in the front-rear direction of the vehicle and an arrangement in which the central axis of the halogen bulb 23 is inclined about ±15 degrees with respect to a horizontal line in a widthwise direction of the vehicle.

Figure 6:
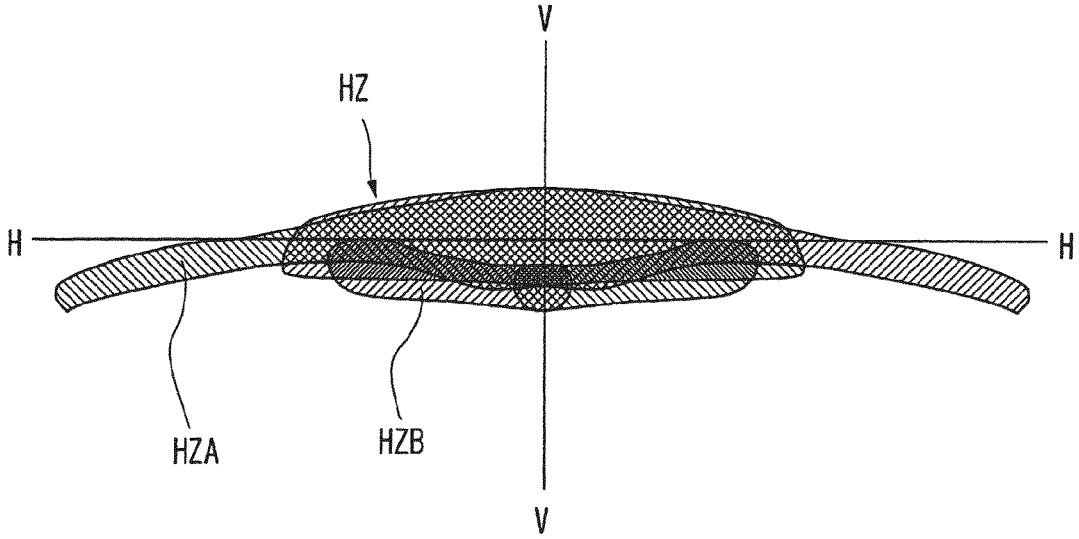
FIG. 6 is a perspective diagram showing a hot zone light distribution pattern from light irradiated from a main reflector of the lamp unit and projected on a virtual vertical screen, which is disposed 25 m ahead of the lamp unit.
Figure 8:
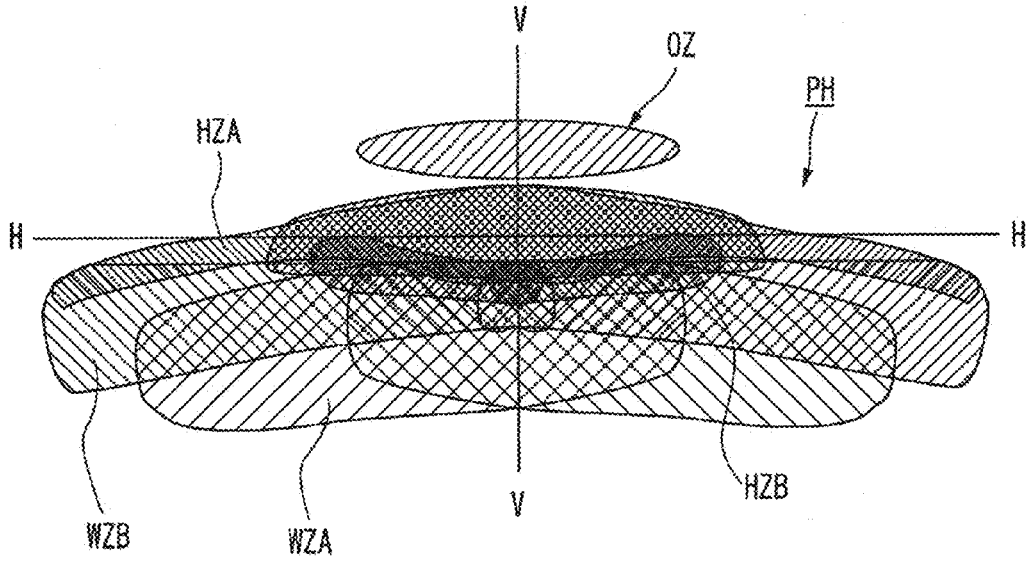
FIG. 8 is a perspective diagram showing a high beam light distribution pattern projected on the virtual vertical screen by the light irradiations from the main reflector and the auxiliary reflector.

The main reflector 25 has reflecting surfaces 25*a*, 25*b*, 25*c*, which forwardly reflect the first part of the light from the light source 23*a* to converge the first part of the light toward the optical axis Ax to form a hot zone HZ (high brightness zone) required for a high beam light distribution pattern PH (see FIGS. 6 and 8).

In the vertical cross-section including the optical axis Ax, the reflecting surface 25*a* has an elliptical shape, which is designed to have a first focal point on a position of the light source 23*a* and a second focal point on the rear focal point F of the projection lens 11. The eccentricity of the elliptical shape is designed to gradually increase from the vertical cross-section toward the horizontal cross-section.

According to this configuration, the light L1 emitted from the light source 23*a* and reflected by the reflecting surface 25*a* is converged to a position in the vicinity of the rear focal point F in the vertical cross-section, and the converging position is moved further forward in the horizontal cross-section, causing a diffused pattern HZA in the hot zone HZ to be formed.

Further, as shown in FIG. 1, the reflecting surface 25*b* is provided on an upper part of the main reflector 25 outside the effective reflecting surface. The light L2 reflected by the reflecting surface 25*b* forms a converged pattern HZB, which irradiates a region below and partially overlapping the diffused pattern HZA formed by the light L1 reflected by the reflecting surface 25*a*.

In other words, the reflecting surfaces 25*a*, 25*b* of the main reflector 25 form the hot zone HZ required for the high beam light distribution pattern PH by synthesizing the diffused pattern HZA and the converged pattern HZB formed by the reflected lights L1, L2, respectively, as shown in FIG. 6.

Furthermore, as shown in FIG. 5, the reflecting surface 25*c* is provided on a portion of the main reflector 25 lateral to the optical axis Ax and above the optical axis Ax as a light diffusing surface, whereby a laterally diffused light L3 can easily be obtained.

As shown in FIGS. 2 and 4, the auxiliary reflector 28 is disposed below the main reflector 25. The auxiliary reflector 28 includes inner reflecting surfaces 50R, 50L, outer reflecting surfaces 51R, 51L, and upwardly reflecting surfaces 52R, 52L. The inner reflecting surfaces 50R, 50L, the outer reflecting surfaces 51R, 51L, and the upwardly reflecting surfaces 52R, 52L forwardly and diffusely reflect the third part of the direct light from the halogen bulb 23 such that the third part of the light passes below the projection lens 11 without entering the projection lens 11.

The inner reflecting surfaces 50R, 50L are disposed right and left of the optical axis Ax, and are parabolic reflecting surfaces extending in the front-rear direction of the vehicle along the optical axis Ax. The inner reflecting surfaces 50R, 50L form a first diffused pattern WZA laterally diffused to the right and to the left below the cutoff line CL.

The outer reflecting surfaces 51R, 51L are disposed on respective sides of the inner reflecting surfaces 50R, 50L, and are parabolic reflecting surfaces extending in the front-rear direction of the vehicle. The outer reflecting surfaces 51R, 51L form a second diffused pattern WZB below the cutoff line CL. The second diffused pattern WZB is more largely diffused to the right and to the left than the first diffused pattern WZA formed by the inner reflecting surfaces 50R, 50L. The outer reflecting surfaces 51R, 51L are configured and arranged to extend downwardly away from the optical axis Ax toward the front to form an acute angle with a vertical plane including the optical axis Ax.

The upwardly reflecting surfaces 52R, 52L are disposed on a front end portion of the auxiliary reflector 28. The upwardly reflecting surfaces 52R, 52L reflect a portion L6 of the third part of the direct light from the halogen bulb 23 upward to form an overhead light distribution pattern OZ for irradiating an overhead sign (OHS).

As shown in FIGS. 3 and 5, the movable shade 30 is formed by pressing a metal plate to have a rectangular plate shape, and is disposed below the optical axis Ax and near the optical axis Ax. Respective side portions of the movable shade 30 are bent to provide bearing sections 30*b* into which a shaft 42 is rotatably inserted and abutting sections 30*c*, which contact the bracket 22 at the shielding position to restrict the rotation of the movable shade 30.

The movable shade 30 is movable between the shielding position, at which the upper edge 30*a* of the movable shade 30 is disposed in the vicinity of the rear focal point F, and the lessened shielding position, at which the amount of the first part of the light reflected by the main reflector 25 and shielded by the movable shade 30 is lessen than the amount of the first part of the light shielded at the shielding position. The upper edge 30*a* of the movable shade 30 is formed so as to have a difference in level between the right and left sections thereof so that, when the movable shade 30 is at the shielding position, the cutoff line CL of a low-beam light distribution pattern PL is formed (see FIG. 9).

On the portion of the upper edge 30*a* that forms a part of the cutoff line on a side of an oncoming vehicle, a protruding section that protrudes upward toward the side end may be formed. This protruding section cuts off a light distribution pattern on the side of the oncoming vehicle that has a risk of leaking upward due to the lens aberration of the projection lens 11, thereby a glare to the oncoming vehicle is prevented.

As shown in FIGS. 2 and 3, the shaft 42 is inserted into the bearing sections 30*b* on the respective side portions of the movable shade 30, and respective ends of the shaft 42 are firmly fitted to the fitting pieces of the bracket 22 and are secured to the rear side of the bracket 22, whereby the movable shade 30 is rotatably supported by the bracket 22.

A stationary shade 33 is provided on the front side of the bracket 22 which is the opposite side of the rear side of the bracket 22 to which the movable shade 30 is attached. The stationary shade 33 prevents stray light from entering the projection lens 11 while allowing the movable shade 30 to rotate.

The movable shade 30 has a rod engaging section 30*d* at the central portion thereof. An upper end engaging part of a rod 40 is coupled to the rod engaging section 30*d*. A return spring 44 is wound around the shaft 42. The return spring 44 is a torsion coil spring made of metal. The return spring 44 has one end joined to the movable shade 30 and the other end is joined to the stationary shade 33 that is fixed to the bracket 22, whereby the movable shade 30 is elastically biased toward the shielding position. When the movable shade 30 is moved toward the shielding position, the abutting sections 30*c* on respective side portions of the movable shade 30 contact the rear face of the bracket 22, whereby the movable shade 30 is positioned at the shielding position.

The actuator 20 is coupled to a lower end engaging part of the rod 40 to move the movable shade 30 between the shielding position and the lessened shielding position.

According to the exemplary embodiment, the actuator 20 is a solenoid disposed below the auxiliary reflector 28 such that an output shaft 21 of the actuator 20 protrudes obliquely downward toward the front of the vehicle. The actuator 20 is secured, with screws, to a lower portion of the main reflector 25 extending below the auxiliary reflector 28.

When a beam selection switch (not shown) is operated, the actuator 20 is driven, and the linear reciprocating motion of the output shaft 21 is transmitted to the rod 40 via a rotation plate 55 of an operation direction converting mechanism 50, thereby rotating the movable shade 30 coupled to the upper end engaging part of the rod 40.

The rod 40 is formed from, for example, a wire rod having the upper and lower end engaging parts bent into an L shape respectively. When the rod 40 reciprocates along a substantially vertical direction, the movable shade 30, the rod engaging section 30*d* of which is coupled to the upper end engaging part of the rod 40, is rotated around the shaft 42 extending in the widthwise direction of the vehicle between the shielding position and the lessened shielding position.

Next, the optical function of the movable shade 30 will be described below.

As shown in FIG. 1 to 5, when the movable shade 30 is at the shielding position, the movable shade 30 is disposed such that the upper edge 30*a* of the movable shade 30 passes through the rear focal point F of the projection lens 11, whereby a portion of the light L1 reflected by the reflecting surface 25*a* of the main reflector 25 is shielded to eliminate most of the light which otherwise would be forwardly and upwardly projected through the projection lens 11 and to form the cutoff line CL of the low-beam light distribution pattern PL.

Regardless of the position of the movable shade 30, the light L4, L5 reflected by the inner reflecting surfaces 50R, 50L and the outer reflecting surfaces 51R, 51L of the auxiliary reflector 28 are forwardly sent.

Figure 9:
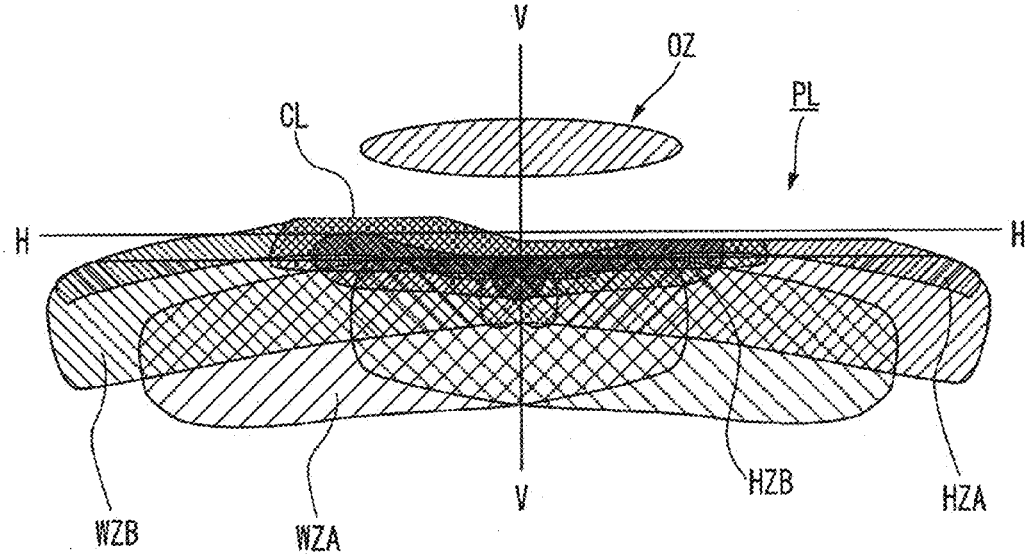
FIG. 9 is a perspective diagram showing a low beam light distribution pattern projected on the virtual vertical screen by the light irradiations from the main reflector and the auxiliary reflector.

Accordingly, when the movable shade 30 is at the shielding position, the unshielded portion of the light L1 reflected by the reflecting surface 25*a* of the main reflector 25 and the light L4, L5 reflected by the inner reflecting surfaces 50R, 50L and the outer reflecting surfaces 51R, 51L of the auxiliary reflector 28 are combined to form the low-beam light distribution pattern PL having the cutoff line CL as shown in FIG. 9. In the exemplary embodiment, the low-beam light distribution pattern PL is adapted for left-hand traffic, and the cutoff line CL is a so-called Z-type cutoff line.

On the other hand, when the movable shade 30 is moved from the shielding position to the lessened shielding position, the upper edge 30*a* of the movable shade 30 is displaced rearward and obliquely downward, whereby the amount of the portion of the light L1 shielded by the movable shade 30 is lessened. In this exemplary embodiment, when the movable shade 30 is at the lessened shielding position, the shielded amount of the light reflected by the reflecting surface 25*a* of the main reflector 25 becomes substantially zero.

Accordingly, when the movable shade 30 is at the lessened shielding position, the light L1 reflected by the reflecting surface 25*a* of the main reflector 25 and the lights L4, L5 reflected by the inner reflecting surfaces 50R, 50L and the outer reflecting surfaces 51R, 51L of the auxiliary reflector 28 are combined to form the high beam light distribution pattern PH as shown in FIG. 8.

In summary, according to the vehicle headlamp 10 of the exemplary embodiment described above, the switching operation between the low beam and the high beam can be implemented by moving the movable shade 30 using the actuator 20 while downsizing the lamp unit 18 in the front-rear direction by fixedly inserting the halogen bulb 23 to the main reflector 25 in the sidewise direction with respect to the optical axis Ax.

Figure 7:
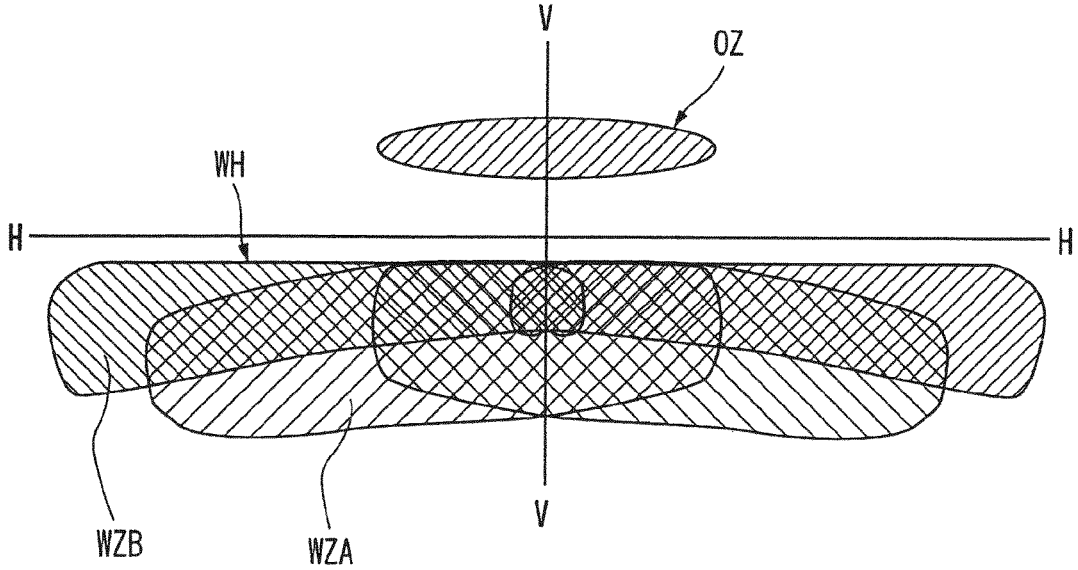
FIG. 7 is a perspective diagram showing a first diffused pattern and a second diffused pattern projected on the virtual vertical screen by light irradiation from an auxiliary reflector of the lamp unit.

Further, the main reflector 25 is designed to forwardly reflect the first part of the direct light from the halogen bulb 23 and to converge the light toward the optical axis Ax, so as to form the hot zone HZ required for high beam light distribution as shown in FIG. 6. On the other hand, the auxiliary reflector 28 is designed to forwardly and diffusely reflect the third part of the direct light from the halogen bulb 23 such that the third part of the light is diffusely distributed below the projection lens 11 without entering the projection lens 11, so as to form the diffused pattern WH required for low beam light distribution as shown in FIG. 7.

That is, in the vehicle headlamp 10 having the configuration described above, the first part of the light reflected by the main reflector 25 is converged toward the rear focal point F of the projection lens 11 to form a high beam light distribution, and the third part of the light reflected by the auxiliary reflector 28 forms a laterally diffused light distribution below the cutoff line CL.

Hence, when the headlamp 10 is used to produce the high beam, the light reflected by the main reflector 25 and converged to the rear focal point F of the projection lens 11 is primarily used to form the high beam light distribution pattern PH. When the headlamp is used to produce the low beam, the light reflected by the main reflector 25 and partially shielded by the movable shade 30 and the light reflected by the auxiliary reflector 28, which is laterally diffused to the right and to the left below the cutoff line, are combined to form the low beam light distribution pattern PL.

More specifically, the light L1, L2, L3 reflected by the reflecting surfaces 25*a*, 25*b*, 25*c* of the main reflector 25 and the light L4, L5 reflected by the inner reflecting surfaces 50R, 50L and the outer reflecting surfaces 51R, 51L of the auxiliary reflector 28 are combined to form the low beam light distribution pattern PL and the high beam light distribution pattern PH. Thus, while the lamp unit 18 is a side insertion type lamp unit and uses the halogen bulb 23 having a smaller light amount than a discharge bulb, the lamp unit 18 can efficiently use the light amount produced from the light source to form the low beam light distribution pattern PL and the high beam light distribution pattern PH.

As a result, in the vehicle headlamp 10 of this exemplary embodiment, the light amount does not become insufficient, and a sufficient level of visibility can be obtained for both the high beam and the low beam.

Furthermore, the auxiliary reflector 28 of the exemplary embodiment described above includes the inner reflecting surfaces 50R, 50L extending in the front-rear direction of the vehicle along the optical axis Ax and the outer reflecting surfaces 51R, 51L extending in the front-rear direction of the vehicle on respective sides of the inner reflecting surfaces 50R, 50L.

More specifically, the inner reflecting surfaces 50R, 50L are parabolic reflecting surfaces extending in the front-rear direction of the vehicle along the optical axis Ax and are used to form the first diffused pattern WZA laterally diffused to the right and to the left below the cutoff line. The outer reflecting surfaces 51R, 51L are also parabolic reflecting surfaces and are used to form the second diffused pattern WZB, which is more widely diffused to the right and to the left than the first diffused pattern WZA below the cutoff line.

Hence, the diffused light L5 reflected by one of the outer reflecting surfaces 51R, 51L of the auxiliary reflector 28 is not shielded by the other of the outer reflecting surface 51R, 51L or by other components, such as an extension, so that a favorable light distribution pattern can be formed.

Further, the outer reflecting surfaces 51R, 51L are formed so as to extend away from the optical axis Ax to the front such that the outer reflecting surfaces 51R, 51L form an acute angle with respect to the vertical plane including the optical axis Ax.

Hence, the light source images of the halogen bulb 23 formed by the light L5 reflected by the outer reflecting surfaces 51R, 51L of the auxiliary reflector 28 are oriented in the vertical direction to form a portion of the cutoff line CL.

The vertically oriented light source images are more advantageous than laterally oriented light source images in that light leakage above the cutoff line is less likely to occur, so that the reflected light can be controlled more easily.

The reflecting surface 25*c* (the diffusing surface) is provided on a portion of reflecting surface of the main reflector 25 lateral to the optical axis Ax, and above the optical axis Ax in the exemplary embodiment. Since the laterally oriented light source image is projected on the portion of the main reflector 25 lateral to the optical axis Ax, the laterally diffused light L3 can be obtained easily.

While the present invention has been described with reference to a certain exemplary embodiment and a modification thereof, it will be understood by those skilled in the art that various changes and other modifications may be made therein without departing from the spirit and scope of the present invention as defined by the appended claims.

For example, while the auxiliary reflector 28 is a separate component from the main reflector 25 and is secured to the lower part of the main reflector 25 in the exemplary embodiment described above, the main reflector 25 and the auxiliary reflector 28 may be formed as a one-piece structure.

Further, while the inner reflecting surfaces 50R, 50L and the outer reflecting surfaces 51R, 51L of the auxiliary reflector 28 are each formed as a parabolic reflecting surface in the exemplary embodiment described above, they may be formed to have various configurations other than parabolic.

What is claimed is:

1. A vehicle headlamp comprising:

a projection lens disposed on an optical axis extending in a front-rear direction of a vehicle;

a halogen bulb disposed behind a rear focal point of the projection lens and below the optical axis;

a main reflector which forwardly reflects a first part of direct light from the halogen bulb to converge the first part of the light toward the optical axis, wherein the halogen bulb is fixedly inserted in the main reflector in a sidewise direction with respect to the optical axis;

a movable shade disposed between the projection lens and the halogen bulb to shield a portion of the first part of the light reflected by the main reflector and a second part of the direct light from the halogen bulb to form a cutoff line of a light distribution pattern;

an actuator which moves the movable shade between a shielding position, at which an upper edge of the movable shade is located in a vicinity of the rear focal point of the projection lens, and a lessened shielding position, at which an amount of the first part of the light shielded by the movable shade is less than an amount of the first part of the light shielded when the movable shade is at the shielding position; and an auxiliary reflector disposed below the optical axis to forwardly and diffusely reflect a third part of the direct light from the halogen bulb such that the third part of the light passes below the projection lens.

2. The vehicle headlamp according to claim 1, wherein the first part of the light reflected by the main reflector is converged toward the rear focal point of the projection lens to form a high beam light distribution, and wherein the third part of the light reflected by the auxiliary reflector forms a laterally diffused light distribution below the cutoff line.

3. The vehicle headlamp according to claim 2, wherein the auxiliary reflector comprises:

an inner reflecting surface which extends in the front-rear direction of the vehicle along the optical axis; and an outer reflecting surface which extends in the front-rear direction of the vehicle on respective sides of the inner reflecting surface, wherein the inner reflecting surface has a parabolic configuration to form a first part of the laterally diffused light distribution, and wherein the outer reflecting surface has a parabolic configuration which forms a second part of the laterally diffused light distribution, which is more widely diffused than the first part of the laterally diffused light distribution formed by the inner reflecting surface.

4. The vehicle headlamp according to claim 3, wherein the outer reflecting surface extends downwardly away from the optical axis toward the front and forms an acute angle with a vertical plane including the optical axis.

5. The vehicle headlamp according to claim 2, wherein the main reflector comprises a light diffusing surface on a portion lateral to the optical axis.

6. The vehicle headlamp according to claim 1, wherein the auxiliary reflector comprises an upwardly reflecting surface, which upwardly reflects a portion of the third part of the light to form an overhead light distribution pattern above the cutoff line for irradiating an overhead sign.

7. The vehicle headlamp according to claim 1, further comprising:

a lamp body having a front opening; and a cover which covers the front opening of the lamp body to form a lamp chamber, wherein the projection lens, the halogen bulb, the main reflector, the movable shade, the actuator, and the auxiliary reflector are configured as a projector-type lamp unit and are accommodated inside the lamp chamber.

* * * * *